US006772707B1

(12) United States Patent
Williamson

(10) Patent No.: US 6,772,707 B1
(45) Date of Patent: Aug. 10, 2004

(54) BALLAST APPARATUS

(76) Inventor: Kenneth Howard Williamson, 4513 Ridgewood Rd., Memphis, TN (US) 38116-7211

( * ) Notice: Subject to any disclaimer, the term of this patent is extended or adjusted under 35 U.S.C. 154(b) by 43 days.

(21) Appl. No.: 10/282,153

(22) Filed: Oct. 29, 2002

(51) Int. Cl.[7] ..... E01F 9/012
(52) U.S. Cl. ..... 116/63 P; 40/612
(58) Field of Search ..... 116/63 R, 63 P; D10/109, 111; D20/17; 40/612, 607.1, 605, 606.19; 256/1, 13.1, 19; 248/910

(56) References Cited

U.S. PATENT DOCUMENTS 3,917,232 A * 11/1975 Lindner ..... 256/64
3,950,873 A * 4/1976 Stehle et al. ..... 40/607.02
4,005,537 A * 2/1977 von Camber et al. ..... 40/610
4,104,980 A * 8/1978 Toomey ..... 116/63 P
4,298,186 A * 11/1981 Glass ..... 256/64
4,383,782 A * 5/1983 Pillifant, Jr. ..... 404/6
4,852,511 A * 8/1989 Look et al. ..... 116/63 P
5,560,732 A * 10/1996 Kulp et al. ..... 404/10
5,762,444 A * 6/1998 Giannelli ..... 404/9
5,860,237 A * 1/1999 Johnson ..... 40/603
5,971,333 A * 10/1999 Fiedor ..... 248/129
6,382,870 B1 * 5/2002 Gertz ..... 404/6
6,560,841 B1 * 5/2003 Letherer et al. ..... 29/428

OTHER PUBLICATIONS

TrafFix Devices, Inc., Type 1 Barricade from the TrafFix Economy Plastic Folding Barricades sales, brochure, copyrighted 1998–2001 TrafFix Devices, Inc., printed from the website on Sep. 4, 2003.*

* cited by examiner

*Primary Examiner*—Diego Gutierrez
*Assistant Examiner*—R. Alexander Smith
(74) *Attorney, Agent, or Firm*—John J. Mulrooney

(57) ABSTRACT

A resilient, impact-resistant, one-piece ballast apparatus is useful to provide external weight and stability for portable barricades and signs. The ballast is a solid, compression molded rubber device having a predetermined weight and design features including thickness, shape, perimeter contour and holes that permit the ballast device to be easily handled, quickly and securely affixed to or removed from barricade and sign structures, and stored for transport or between uses. The flat surface of the ballast permits application of identifying indicia of ownership that prevents loss and promotes reuse with resultant savings of economy and resources.

17 Claims, 2 Drawing Sheets

BALLAST APPARATUS

BACKGROUND OF THE INVENTION

1. Field of the Invention

The present invention relates generally to ballast apparatus for providing stabilizing weight for lightweight structures such as portable barricades and signs and, more particularly, to a solid, one-piece, resilient, impact-resistant compression molded rubber ballast having features including a predetermined shape, perimeter, weight and holes that permit the device to be easily handled, affixed to and removed from barricade and sign structures, and stored for transport or between uses.

2. Description of the Related Art

The use of portable, lightweight barricades and signs with reflective stripe markings thereon to control or channel vehicular and pedestrian traffic, or to warn drivers and pedestrians of hazards, or for use at construction work sites or for crowd control, is well known. Such barricades are made of lightweight materials such as plastic that require added weight or ballast to stabilize and maintain the barricades in place against wind and other forces. The most commonly used ballast consists of bags of sand or other particulate material that are placed on the structural members of the barricade to provide weight and prevent inadvertent movement by the wind. See, e.g., U.S. Pat. No. 4,298,186 and U.S. Pat. No. 5,762,444, for lightweight barricades with openings in the support members thereof where ballast in the form of sandbags may be placed to provide stability to the barricade. The disadvantages of using sandbags as ballast for barricades are well known. The use of sandbags is labor intensive in that the bags must be filled with sand and transported to the work site. Unless the bags are prepared by a machine, the weight of the ballast is not easily controlled. The attachment of sandbags to the barricade is a problem in that regulations prevent the placement of any object over the reflective stripes, which must remain visible at all times, whereby little space on the barricade is available for ballast. Sandbags are not easily attached to barricades and, consequently, are usually loosely placed on a structural member of the barricade, whereby the sandbags are easily knocked off or detached from the barricade. If it is desired to securely affix the bags to the barricade, additional labor is required. The bags are not durable and break easily when run over by vehicles or dropped or after several uses, which requires the ballast to be continuously monitored and frequently replenished. The presence of the particulate ballast material on the roadway poses a safety hazard with the use of bags of particulate material. Sandbags must be removed when the barricade is moved to another job site and, consequently, usually are discarded after use.

Prior attempts to overcome the disadvantages of using sandbags for ballast involve the design of barricades and signs having built in ballast systems. See, e.g., U.S. Pat. No. 3,917,232; U.S. Pat. No. 4,104,980; and U.S. Pat. No. 4,852,511. However, such barricade and sign systems still require the ballast material to be placed and removed before and after each use of the barricade or sign and do not solve the problem of allowing louse particulate ballast material to be scattered on the roadway when a vehicle impacts the barricade.

It is therefore desirable to provide an improved ballast apparatus that avoids the problems inherent in the use of bags of particulate material such as sand for ballast.

It is another object of the present invention to provide a ballast apparatus that replaces sandbags or loose particulate material such as sand as the ballast used in barricades.

It is another object of the present invention to provide a solid, one-piece, highly portable ballast apparatus having a controlled weight.

It is another object of the present invention to provide a durable and reusable ballast device.

It is another object of the present invention to provide a ballast apparatus that eliminates the need to continuously monitor and frequently replenish ballast material on barricades.

It is another object of the present invention to provide a ballast apparatus that is easily affixed to a barricade or sign and resists dislodgment therefrom.

It is another object of the present invention to provide a ballast apparatus that is convenient to handle and easily stored during transport or for reuse.

It is another object of the present invention to provide a ballast apparatus that is crashworthy and performs in a predictable manner when inadvertently struck by a vehicle or other object.

It is another object of the present invention to provide a ballast apparatus that, when impacted, does not disintegrate into fragments or other debris that pose a hazard to road users and workers.

It is another object of the present invention to provide a ballast apparatus that is designed to have a shape that permits the ballast to fit within interstitial spaces within the structural members of existing barricades.

It is another object of the present invention to provide a ballast apparatus having surface features that permit the ballast to be placed within or attached to the structural members of existing barricades.

BRIEF SUMMARY OF THE INVENTION

The present invention is an improved ballast apparatus that is useful to provide weight for barricades, signs and other structures requiring ballast for stability against wind and other forces that act on barricades and signs. The improved ballast apparatus is a one-piece, resilient, impact-resistant compression-molded rubber device having design features including a predetermined weight, shape, perimeter and holes that permit the device to be easily handled, quickly and securely affixed to or detached from barricade and sign structures, and stored for transport or between uses. The solid, resilient ballast device is unbreakable so that there is no loss of particulate ballast material or fragmentation into unsafe debris as a result of an inadvertent impact with a vehicle or other object. The weight of the ballast apparatus is easily predetermined and controlled because the apparatus is made in a compression molding process. The features of the improved ballast apparatus provide a reusable ballast that is useful with any existing or future barricade or sign that has an opening in a frame member to receive the ballast device or a frame member to which the ballast device may be attached.

DETAILED DESCRIPTION OF THE INVENTION

Figure 1:
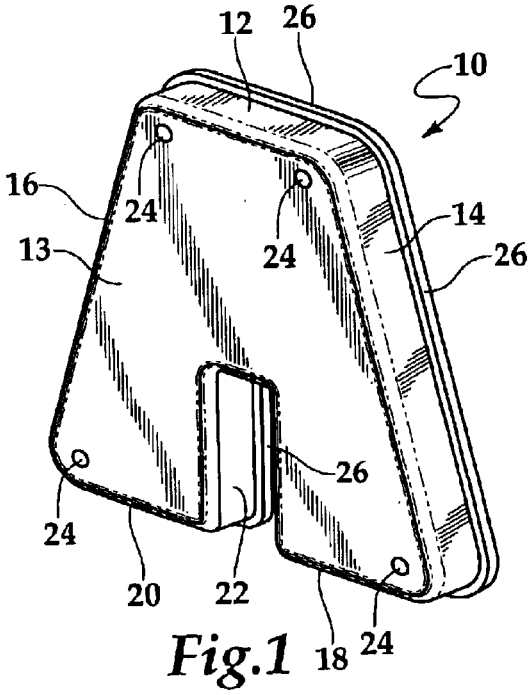
FIG. 1 is a perspective view of one embodiment of the ballast apparatus of the present invention.

Referring to the drawings, there is disclosed a ballast apparatus according to the present invention comprising an A-shaped apparatus designated generally by the numeral 10. The ballast 10 has a top side 12, a front side 13, a right side 14, a back side 15, a left side 16, a right leg 18, a left leg 20, and a vertical slot 22 centered between legs 18 and 20. A plurality of holes 24 are positioned at the corners of and extend through the ballast device 10. The apparatus has a lip or flange 26 at its outer edge or perimeter that completely encircles the device.

It will be appreciated that the ballast apparatus disclosed herein may take different shapes or forms such as, for example, circular or square or rectangular or L-shaped, all of which are within the scope of the invention disclosed and claimed herein. The perimeter shape or contour of the ballast 10 may be dictated by the design features of the barricade with which the ballast will be used. In the A-shaped embodiment of the ballast 10 illustrated in FIG. 1, the dimensions are: weight approximately 9.5 pounds; height approximately 12¾ inches; top width approximately 7¾ inches; bottom width approximately 14¾ inches; and flange 26 approximately ½ inch.

The ballast 10 may be formed as a solid, one-piece device by a compression molding process from recycled rubber such as discarded automobile tires, which provide the benefits and features of being ultraviolet light resistant, non-breakable and impact resistant. The rubber construction prevents the generation of sparks and a hazardous situation in the event of a collision with a vehicle. The molding process allows the weight, shape and perimeter contour features of the ballast device to be predetermined and controlled.

Figure 5:
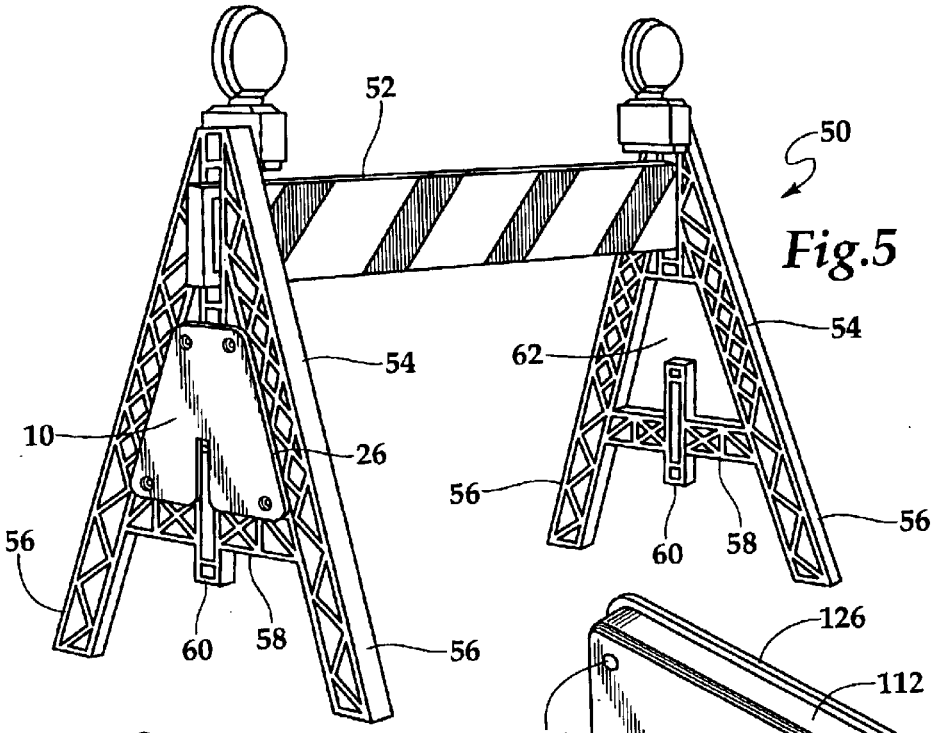
FIG. 5 is perspective view of an A-frame type barricade with the ballast apparatus shown in FIG. 1 is positioned in an opening in one of the barricade's end supports.

FIG. 5 is a perspective view of an A-frame type barricade, generally indicated by the reference 50, of the type disclosed in U.S. Pat. No. 5,762,444. The barricade includes a rail member 52 that is maintained in a generally horizontal position by a pair of support members 54. The support members 54 comprise leg portions 56 connected by cross brace members 58. The brace members 58 include vertically extending brackets 60 that are adapted to receive an additional rail (not shown). The support members have generally A-shaped open spaces 62 therein that are framed at the top and on either side by the leg portions 56 and on the bottom by the cross brace member 58. Prior to the present invention, ballast was added to barricade 50 by placing sandbags on the cross brace members 58 within the A-shaped opening 62. It will be seen that the ballast device 10 of the present invention has a generally A-shape and is designed to be received in the open spaces 62 in the support members 58. The dimensions of the ballast device 10 and the open spaces 62 in the support members 54 are such that the ballast device 10 can be pressed into and fit snugly within the open spaces 62 and the flange 26 will prevent the ballast device from being pushed entirely through the open space 62. Ideally, the thickness of ballast 10 will be approximately one-half the thickness of support members 58 so that two ballast devices 10 may be placed within the openings 62 (not shown) when additional weight is needed to stabilize barricade 50. When two ballast devices 10 are positioned in opening 62, bolts or other fastening means (not shown) may be used in connection with holes 24 in ballast devices 10 to secure the ballast devices in openings 62. It will be appreciated by those skilled in the art that, once ballast devices 10 are positioned in openings 62, the barricade support members 58 may be transported without removing ballast devices therefrom because the ballast devices fit within openings 62 and permit support members 58 to be stacked as if the ballast devices 10 were not present.

Figure 7:
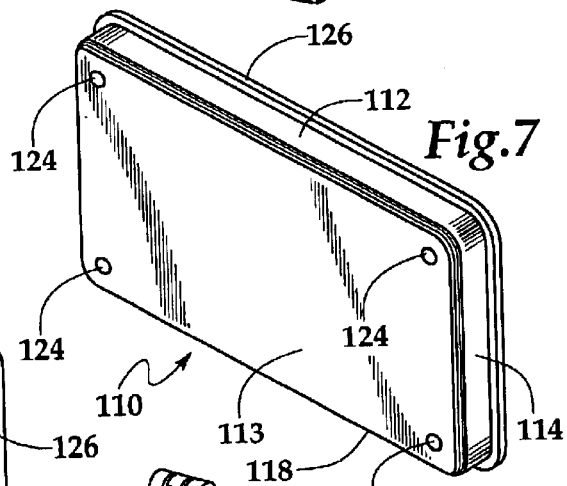
FIG. 7 is a perspective view of the reverse side of the ballast apparatus shown in FIG. 6.
Figure 6:
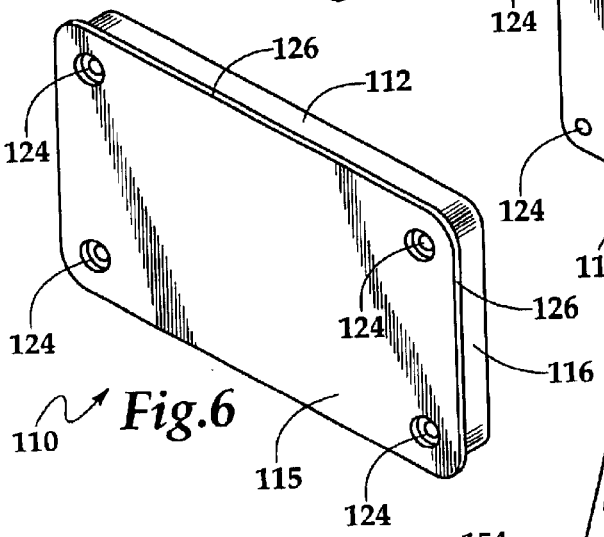
FIG. 6 is a perspective view of another embodiment of the ballast of the present invention having a rectangular shape.

Referring to FIGS. 6 and 7, another embodiment of the ballast apparatus of the present invention, generally indicated by the reference 110, has a rectangular shape. The rectangular ballast 110 has a top side 112, a front side 113, a right side 114, a back side 115, a left side 116, and a bottom side 118. A plurality of holes 124 are positioned at the corners of and extend through the ballast device 110. The ballast apparatus has a lip or flange 126 at its outer edge that completely encircles the ballast device.

Figure 8:
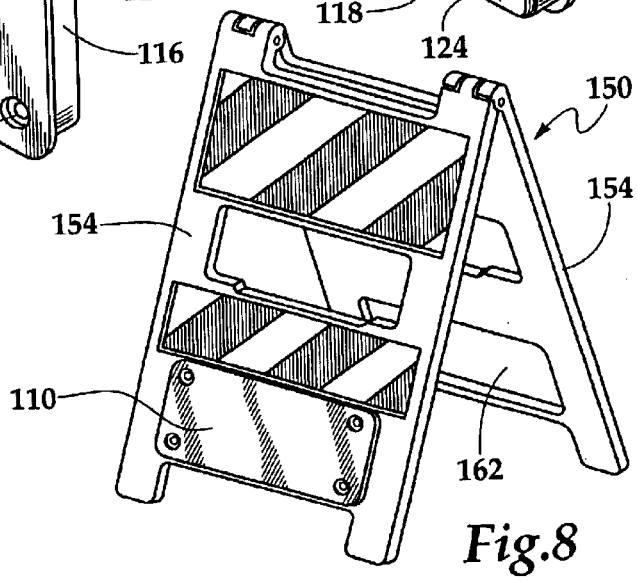
FIG. 8 is a perspective view of a barricade having structural members with a rectangular shaped opening in which the ballast apparatus shown in FIG. 6 is positioned.

FIG. 8 is a perspective view of a barricade, generally indicated by the reference 150, of the type disclosed in U.S. Pat. No. 4,298,186. Barricade 150 has a pair of frame support members 154 with rectangular-shaped open spaces 162 therein that, prior to the present invention, were used for the placement of sandbags to provide ballast and stability to the barricade. The ballast device 110 shown in FIGS. 6 and 7 has a rectangular shape that is designed to fit in the rectangular openings 162 and replace the sandbags that have heretofore been placed in the openings 162 in the barricade frame members 154. Ballast device 110 has a lip 126 that prevents the ballast device from being pushed entirely through opening 162.

It will be appreciated that the ballast apparatus of the present invention could be constructed in other shapes in addition to the A-shape 10 and rectangular shape 110 to be useful with barricades having different shaped openings in its structural members and still provide the benefits disclosed herein.

Figure 2:
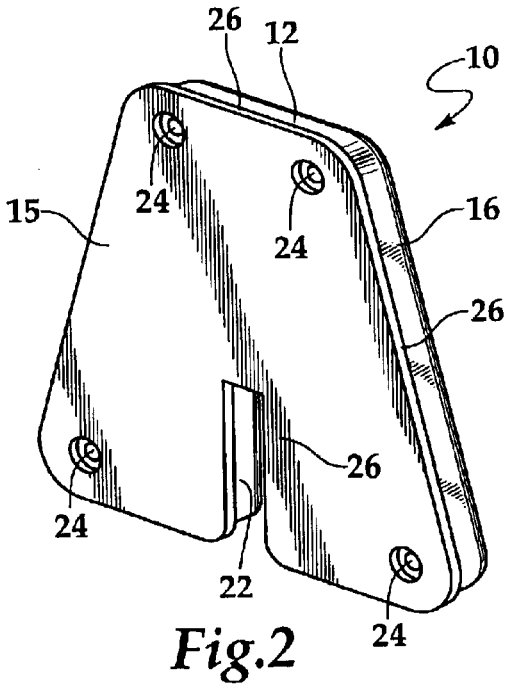
FIG. 2 is a perspective view of the reverse side of the ballast apparatus shown in FIG. 1.
Figure 3:
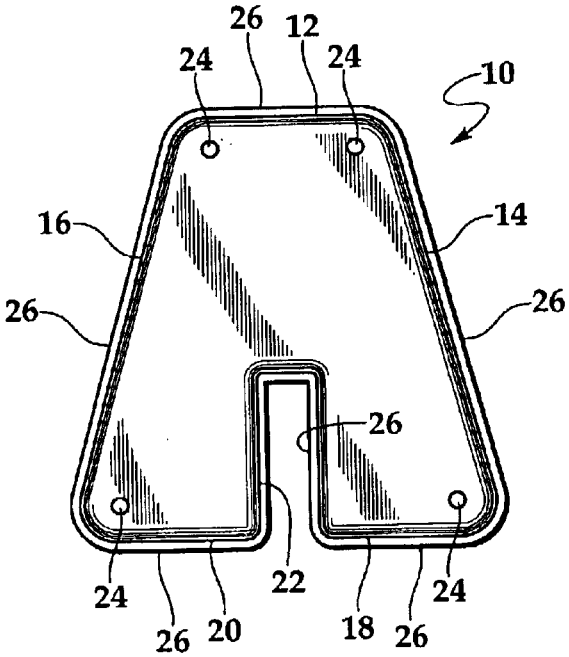
FIG. 3 is front elevation view of the ballast apparatus shown in FIG. 1.
Figure 4:
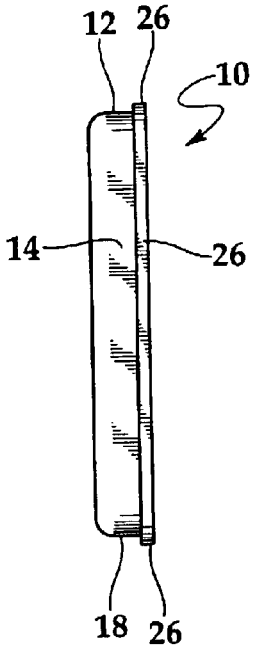
FIG. 4 is a side elevation view of the ballast apparatus shown in FIG. 1.

It will be appreciated that some existing barricades do not have, and some future barricades may not have, structural members with interstitial spaces and openings capable of receiving the ballast device of the present invention, that is, into which the ballast apparatus of the present invention could be placed. For example, U.S. Pat. No. 4,852,511 discloses a barricade having support members or legs without openings therein. The feature of the holes 24 in the A-shaped ballast 10 shown in FIGS. 1 and 2 and the holes 124 in the rectangular ballast 110 shown in FIGS. 6 and 7 permits the use of the ballast apparatus of the present invention with the barricade of U.S. Pat. No. 4,852,511 by using fastening means such as bolts or ties to attach ballast device 10 or ballast device 110 the structural members of the barricade.

For a barricade such as that disclosed in U.S. Pat. No. 4,104,980 that do not have any features on the support members for the attachment of the ballast apparatus of the present invention, the ballast device 10 or ballast device 110 can be attached by drilling holes in the legs and connecting the ballast device to the legs by using holes 24 or 124 and fastening means such as bolts or ties.

While certain respective embodiments have been shown for the purpose of illustrating the invention, it will be apparent to those skilled in the art that various changes and modifications may be made without departing from the spirit and scope of the invention, and all such modifications as would be obvious to one skilled in the art are intended to be included within the scope of the following claims.

I claim:

1. Apparatus in combination with a barricade for providing external weight to the barricade, comprising:

a barricade comprising a structural member having an opening with a fixed shape; and ballast means for stabilizing and adding external weight to the barricade, the ballast means comprising a solid device having substantially the same shape as the opening and adapted to fit within the opening.

2. The apparatus of claim 1, wherein the solid device has a flange around its perimeter which is incapable of passing through the opening.

3. The apparatus of claim 1, wherein the perimeter of the opening has a generally A shape and the perimeter of the solid device has a generally A shape.

4. The apparatus of claim 1, wherein the perimeter of the opening has a rectangular shape and the perimeter of the solid device has a rectangular shape.

5. The apparatus of claim 1, wherein the solid device comprises rubber.

6. The apparatus of claim 1, wherein the solid device has a thickness approximately one half the thickness of the structural member.

7. The apparatus of claim 1, wherein the solid device has a hole therein and a thickness approximately one half the thickness of the structural member; and further comprising a first solid device and a second solid device positioned in the opening; and means for securing the first solid device and the second solid device in the opening.

8. The apparatus of claim 1, wherein a hole extends through the solid device.

9. A combination, comprising:

a barricade comprising a structural member having an interstitial opening comprising a perimeter with a defined contour; and ballast means for stabilizing and providing external weight to the barricade comprising a solid device having a perimeter with a contour substantially the same as the contour of the opening, the solid device being capable of placement in the interstitial opening.

10. The combination of claim 9, wherein the solid ballast device comprises rubber.

11. The combination of claim 9, wherein the solid ballast device has a thickness approximately one-half the thickness of the structural member.

12. The combination of claim 9, wherein the solid ballast device has a perimeter surrounded by a flange which is incapable of passing through the opening.

13. The combination of claim 9, wherein a hole extends through the solid device.

14. Apparatus in combination with barricades or signs for providing external weight to the barricades or signs, comprising:

a barricade or sign comprising a structural member having a fixed thickness and an open space with a fixed shape; and ballast means for stabilizing and providing external weight to the barricade or sign comprising a solid device having a predetermined weight and a predetermined shape substantially the same as the shape of the open space, the solid device being positioned in the open space.

15. The apparatus of claim 14, wherein the solid rubber device has a perimeter surrounded by a flange which is incapable of passing through the open space.

16. The apparatus of claim 14, wherein a hole extends through the solid device.

17. The apparatus of claim 14, wherein the solid device has a thickness approximately one half the thickness of the structural member.

* * * * *